United States Patent [19]

Morey et al.

[11] 4,067,502

[45] Jan. 10, 1978

[54] FLOTATION SEPARATION OF GLASS FROM A MIXTURE OF COMMINUTED INORGANIC MATERIALS

[75] Inventors: Booker W. Morey, Pasadena; William R. White, Upland, both of Calif.

[73] Assignee: Occidental Petroleum Corporation, Los Angeles, Calif.

[21] Appl. No.: 678,080

[22] Filed: Apr. 19, 1976

Related U.S. Application Data

[63] Continuation-in-part of Ser. No. 467,854, May 8, 1974, abandoned, which is a continuation-in-part of Ser. No. 172,888, Aug. 18, 1971, abandoned.

[51] Int. Cl.[2] ..... B03B 1/04

[52] U.S. Cl. ..... 241/20; 209/3; 209/166; 241/DIG. 38

[58] Field of Search ..... 209/166, 3, 167, 12, 209/17; 241/20, 24, DIG. 38

[56] References Cited

U.S. PATENT DOCUMENTS

| | | | |
|---|---|---|---|
| 2,205,403 | 6/1940 | Trotter | 209/166 |
| 2,304,580 | 12/1942 | Cole | 209/166 |
| 2,307,397 | 1/1943 | Falcuner | 209/166 |
| 2,384,825 | 9/1945 | Ellis | 209/3 |
| 2,409,665 | 10/1946 | Cole | 209/166 |
| 2,433,633 | 12/1947 | Stokes | 209/166 |
| 2,539,486 | 1/1951 | Scott | 209/166 X |
| 3,640,862 | 2/1972 | Gieseke | 209/166 |
| 3,650,396 | 4/1972 | Gillespie | 209/3 |
| 3,687,062 | 8/1972 | Frank | 209/38 |

OTHER PUBLICATIONS

Deco Tre Foil, Spring Issue, 1970, pp. 9–16.
Chem. Abst., vol. 74, 129530e, 1971.

*Primary Examiner*—Robert Halper
*Attorney, Agent, or Firm*—Christie, Parker & Hale

[57] ABSTRACT

Particulate glass values contained in a comminuted inorganic fraction and having the particle of a size up to about 10 mesh are recovered by froth flotation using an amine as the beneficiation reagent.

48 Claims, No Drawings

FLOTATION SEPARATION OF GLASS FROM A MIXTURE OF COMMINUTED INORGANIC MATERIALS

CROSS REFERENCE TO RELATED APPLICATIONS

This is a continuation-in-part of our application Ser. No. 467,854, filed May 8, 1974 now abandoned which is a continuation-in-part of our application Ser. No. 172,888, filed Aug. 18, 1971, now abandoned.

BACKGROUND OF THE INVENTION

Immense and ever increasing amounts of solid trash, particularly of a municipal nature, are being generated each day. Disposal problems are growing with equal complexity. Conventional methods of refuse disposal, such as land fill or mere incineration, are becoming prohibitively expensive or creating serious pollution problems.

In particular, land fill areas are becoming fewer in number and further from the sites where the majority of the trash is generated and incineration, because of national concern over the problems of air pollution, is being looked at with ever increasing skepticism.

Municipalities are, therefore, turning to techniques for processing solid wastes to recover, for resale or reuse, the values contained therein. This reduces the problems of pollution and helps offset the cost of processing the trash.

A general method of processing trash involves segregating the organic matter from the inorganics which includes metals, concrete, bricks, glass and the like.

The organics may be processed for recovery as saleable materials such as paper pulp and the balance pyrolyzed to form char and a gaseous stream containing chemicals, which may be condensed as saleable commodities, and char which has an economic value of its own.

With respect to the inorganic matter, ferrous materials may be separated magnetically prior to or following separation of the organics. The remaining inorganics are comminuted by crushing or grinding into particles of fine size. Some may be separated by screening and other by heavy media separations.

SUMMARY OF THE INVENTION

According to the present invention there is provided a process for the separation of particulate glass from comminuted inorganic matter, such as the residue from solid waste processing operation, by a beneficiation process which involves flotation of glass particles up to about 10 mesh, preferably up to about 20 mesh from the comminuted inorganic matter of comparable size. The preferred lower limit is about 325 mesh, more preferably about 200 mesh. The most expeditious particle size range for flotation is from about 325 to about 20 mesh, preferably from about 200 to 20 mesh and more preferably from about 150 to 28 mesh. Flotation occurs using as the beneficiation flotation reagent an amine containing from about 8 to about 22 carbon atoms in at least one hydrocarbon group attached to a nitrogen. The preferred amines are the primary and secondary amines.

The process involves, in general, forming a mass of particulate inorganic matter containing crushed particulate glass obtained, for instance, as a consequence of the several crushing and grinding operations attendant to the processing of solid wastes for recovery of the values contained therein and which, in any instance, include particles which are non-responsive to the action of the beneficiation action of the amine to cause the particulate glass particles to concentrate in the float fraction.

The inorganic fraction may be treated as such if the glass has already been reduced to a particle size less than about 10 mesh, preferably less than about 20 mesh or generally passed through one or more additional comminuting operations to achieve a further reduction in size of the glass particles.

While other inorganics of larger particle size may be present, the mass of particulate inorganic matter is then generally screened or classified to separate out most of the metals and other inorganic residues having a particle size greater than the desired mesh size. That component of the inorganic matter which passes through the initial screening or classifying operation if not subjected to flotation as such is deslimed and classified to remove the particles having a size smaller than a minimum preselected mesh size, and the balance processed for the recovery of particulate glass by conventional beneficiation operations using an amine glass flotation reagent. As indicated, the preferred minimum mesh size is presently about 325 mesh and more preferably 200 mesh.

While an amine or a mixture of amines may be used alone as the glass flotation reagent, the reagent, for reasons of economy, may be extended using conventional hydrocarbon extenders such as kerosene, mineral oil, fuel oil and the like. In addition, there may be included frothers which aid in the formation of a foam such as pine oil, methyl isobutyl carbinol, methyl glycol ether and the like, as are generally known to the art.

A most unique feature of applying flotation separation of particulate glass particles from the particulate mass of inorganic matter is the comminuted residue of bricks, crushed stone and cementitious matters which remain with the residual inorganic tailing rather than becoming part of the float fraction. Had heavy media separations been employed, these constituents would have been combined with the glass along with the lighter metals limiting, as a consequence thereof, the economic value of the glass recovered and the end uses to which it may be applied.

DESCRIPTION

According to the present invention there is provided a process for the separation of particulate glass from a mass of generally inorganic matter which may be formed as a consequence of the treatment of solid wastes for recovery of values contained therein.

The practice of the process of this invention relates to the selective flotation of particulate glass from a comminuted inorganic material including glass particles to a size less than about 10 mesh, preferably less than about 20 mesh. More expeditiously the particles subjected to flotation are in the range of about 325 mesh to about 20 mesh, preferably from about 200 to about 20 mesh, and more preferably from about 150 to about 28 mesh. Formulation of the particles for flotation may be by a combination of screening, comminuting and desliming operations. The glass is then separated from the mass of inorganic matter of a similar particle size by a flotation process using as the flotation reagent at least one amine containing a hydrocarbon having from about 8 to about 22 carbon atoms, in at least one hydrocarbon group attached to a nitrogen atom as the selective flotation reagent for the glass particles. The preferred amines are primary amines and secondary amines with primary amines being particularly preferred.

Typical of the glasses to be principally beneficiated in accordance with this invention are common bottle or container glass, window or plate glass and incandescent lamp envelopes. They are generally known as soda-lime glasses. The analysis of such glasses is from about 70 to about 73 percent by weight $SiO_2$, from 11 to about 18 percent by weight $Na_2O$, from about 7 to about 17 percent by weight CaO, the remainder essentially being other metal oxides as colorants and the like. Included in the calcium oxide analysis is magnesium oxide $Mg_2O$, a substitute for calcium oxide to reduce cost and may be present in an amount of from about 3 to about 5 percent by weight based on the total weight of the glass. The most common species is formed from a mixture of about 72 percent by weight silica, about 15 percent by weight soda, about 10 percent by weight lime and magnesia, about 2 percent by weight alumina and about 1 percent by weight miscellaneous oxides.

The amine flotation reagents which may be used in accordance with the present invention, are not narrowly critical, and are generally obtained by the reaction of a lower molecular weight amine with a straight or branched chain alkane; a straight or branched chain alkene; a saturated or unsaturated or hydroxylated fatty acids or a hydrocarbon containing additional secondary or tertiary amine groups. Salts of the amines may be used including quaternary ammonium salts.

Illustrative but no wise limiting of the primary amines which may be used as selective flotation reagents for the separation of particulate glass from a comminuted mass of inorganic matter, there may be mentioned tallowamine acetate; N-hexadecylamine acetate; N-octadecylamine acetate; laurylamine acetate; primary amines derived from cocoa fatty acids, tallow fatty acids, soya fatty acids, castor fatty acids, oleylamine acetate; dihydroabietyl amine; primary tallow amine hydrochlorides, cotton-seed oil amine hydrochloride, N-oleyl-1,3-propylene diamine; N-tall oil-1,3-propylene diamine; N-tallow oil-1,3-propylene diamine, N-cocopropylene diamine, N-laurylpropylene diamine, and the like.

Illustrative but no wise limiting of the secondary amines which may be used as flotation reagents in accordance with the practice of this invention there may be mentioned the condensation products of tall oil and diethylene triamine, dicocoamine, dilaurylamine, dihydrogenated tallowamine, dioctylamine, and the like.

Useful tertiary amines include the reaction products of tall oil and N,N dimethyl-propylene diamine, tricocoamine, trilaurylamine, trioctylamine, lauryldimethylamine, and the like.

As useful quaternary ammonium salts there may be mentioned dodecyl benzyl dimethyl ammonimum chloride, octyl trimethyl ammonium chloride, lauryl colamino formyl methyl pyridinum chloride and the like.

The amines may generally be used over a pH range from about 5 or less to about 10 or more depending on the amine. Neutral conditions are preferred.

The amount of amine required to achieve effective separation of particulate glass from a generally grouping inorganic matter is not narrowly critical and will depend in part upon the glass content of the grouping particle size as well as whether an extender and/or a frothing agent is used in combination with the amine.

For the run of the mill, finely divided inorganic residue which may be found as the tailing from the treatment of solid wastes, there may be employed from about 0.15 lb. to about 2 lbs. of amine per ton of finely divided inorganic matter, preferably from about 0.5 lb. to about 2 lbs. per ton.

As indicated, there may be used with the amine an extender which serves, in general, to reduce the cost of the collector reagent used in the beneficiation flotation operation, particularly where the selected amine is fairly high in cost. Extenders used are generally conventional to the art and include among others, kerosene, fuel oil, mineral oil, bunker C oil, Stoddard's solvent and the like. When employed, the extender is normally present in the amount of from about 0 to about 3 lbs. per ton of inorganic residue.

Although not necessary to the practice of the process of this invention, there may be included conventional frothing aids such as pine oil, methyl-isobutyl carbinol, 2-ethylisohexanol, methyl amylalcohol, polypropylene glycol and methylglycolether and the like. In general, the amount of frothing agent which may be included in the flotation system may range from 0 to about 0.5 lbs. per ton of the inorganic residue processed.

While the process of this invention may be applied for the flotation separation of particulate glass from any finely divided aggregate of inorganic matter, it will be particularly described in terms of treatment of the tailings of a process for recovery of values from solid wastes.

Such an operation may begin by separating large paper stock by elutriation prior or subsequent to separation of the ferrous materials by conventional magnetic separation means. Independent of whether these preparatory operations are carried out, the balance of the trash is normally comminuted using conventional crushing and grinding operations and classified into an organic fraction and inorganic fraction.

Some portion of the organic fraction is generally formed into paper pulp for resale and the balance of residue pyrolyzed to form char and a gaseous stream containing recoverable chemicals.

As indicated, magnetic separation is generally employed at some point to separate from the waste ferrous materials which are, in turn, processed by various means to maximize the scrap value of the ferrous materials.

What generally follows is a series of comminuting, crushing and screening operations including the possibility of treatment with chemical reagents to recover, to the extent possible, the remaining metallic constituents such as copper, aluminum, brass and the like.

Soft metals, for instance, may be flattened as a consequence of crushing of the more friable materials and recovered by screening operations.

As more and more of the contained values are recovered by crushing, screening and heavy media separations, a finer residue of inorganic materials generally remains.

One of the more difficult constituents of this inorganic residue to separate as a clean fraction is glass. Glass is normally crushed to a fine state along with bricks, rock, concrete and similar cementitious materials in the several operations carried out during the processing of waste solids for the initial recovery of valuable metals. This residue may contain a variety of materials ranging from crushed metal particles which have eluded the separations, crushed brick, rock, concrete and glass and even egg shells which form a generally nondescript inorganic tailing fraction.

An initial separation of a fraction containing particulate glass from the balance may be made by a screening operation. To achieve flotation in accordance with the practice of this invention, it is preferred to employ screening operations which will eventually pass particles containing the glass and be finer than about 10, preferably about 20 mesh. If there has been incomplete crushing of the glass particles prior to this stage additional finer comminution operations may be employed to further reduce particle size.

An initial screening operation may, for instance, be employed to separate a good portion of the sand, dirt and miscellaneous solids having a particle size greater than the selected upper mesh size. The inorganic residue remaining and containing the glass particles may also be subjected, if desired, to heavy media separation wherein materials having a density equal to, or less than, the materials of a density greater than the media are floated off by merely filling a vessel containing the nondescript inorganic residue with the heavy media to an overflowing state such that the heavy media will carry away from the denser inorganic materials, glass materials and other materials of equivalent or lower density. This, as indicated, has proven to be an unsatisfactory separation where it is desired to free the glass fraction of comminuted brick and other cementitious materials. That resultant agglomerate finding only limited utility as "glasphalt" for road repairs.

There is, therefore, carried out in accordance with the practice of this invention, a process for providing a glass fraction which is essentially free of other materials. As previously indicated, the first stage is to form an inorganic fraction having a particle size less than about 10 mesh, preferably 20 mesh. This fraction may then be deslimed and classified to form a mixture comprising particles of greater than about 325 mesh, preferably greater than 200 mesh, and more preferably greater than about 150 mesh. If secondary separation occurs, the fines are removed from the system as a slime and discarded.

In particular, the inorganic fraction containing the crushed glass can be prepared by initially feeding the inorganic residue containing the glass to a crushing device which uses a compressive action rather than shear functions to achieve compaction of the softer metals for screening. Examples of such comminution devices include gyratory crushers, cone crushers, roll crushers, rod mills, jaw crushers and the like. The use of a rod mill for both the flattening and grinding operations is especially effective.

Friable or brittle materials, including any large glass particles, are broken into small fragments which pass through the screening operations while the more ductile materials are flattened for separation by screening. When heavy metals are present, fine crushing is preferred to coarser crushing or extensive grinding.

After the desliming operation, the inorganic residue which has the select particle size or particle size range is then passed to a conventional flotation cell where there is added a beneficiating amount of at least one amine with or without an extender and/or a frothing agent to cause froth flotation of the glass. The glass fraction may be characterized by the substantial absence of finely crushed brick, rock and cementititious materials but may contain magnetic materials. This fraction may be passed through additional flotation separation procedures to achieve an even finer purification of the glass fraction, the inorganic residue which remains after each froth flotation is either processed for recovery of values contained therein or discarded. If there is carried over with the glass ferromagnetic materials as slag, the slag can be separated from the glass by a conventional magnetic separator.

Any organics present, depending on whether they are water wet, may appear in the float or the tailing. Extremely light particles such as mica and talc will appear in the float as will particles responsive to the amine reagent. The tailings will contain particles which are non-responsive to the amine reagent as well as particles for which the amine is less selective as compared to glass.

A particle advantage of the process of this invention is that the particle size of the glass formed as a consequence of the flotation operation can be controlled to be particular utility for direct feed to glass fabricating operations for the formation of glasses, containers and like objects. At present, the acceptable particle size range for this application is most readily obtained from about 325 to about 20 mesh cut, preferably from about 200 to about 20 mesh cut. The present practical limiting factor is the percentage of fines less than about 150 mesh in the glass float. If too great, screening may be employed after flotation. As to the coarser particle size, secondary screening may be used to remove "stones."

In general, for the broadest particle size range, the finer particles of material other than the glass tend to float with the glass and consume more of the reagent. Accordingly, if a secondary screening operative is not employed, a float of lower glass purity will be obtained at least in the rough float and reagent concentration must be increased but without necessary deviating amine from the concentration ranges prescribed herein. In any event, however, there will occur, in accordance with this invention and beneficiation of glass that is, a concentration of glass in float as compared to glass concentration in the inorganic mass and a diminution of glass in the tailings.

While the process of this invention has been described primarily in terms of obtaining a pure glass fraction by flotation during the processing of solid wastes, it will be appreciated by one skilled in the art that the process may be employed for obtaining a pure glass fraction from many mixtures of glass and generally inorganic matter by reducing particle size of the mixture to a size compatible with the flotation operation and then floating the glass fraction from the balance of the inorganic matter using the primary amines described herein.

EXAMPLE 1

A large quantity of a dry inorganic fraction obtained in the processing of municipal wastes and containing glass fragments was comminuted in a cone crusher adjusted to yield a finely ground product. Over 99% of the glass and the brittle material formed passed through a 3 mesh screen which, in turn, retained about 70% of the metals in the original inorganic fraction. The metallic content of the fraction which exceeded 3 mesh was found to exceed 95%.

The balance of the inorganic fraction was screened at 28 mesh and the portion coarser than 28 mesh in size was ground in a ball mill until at least the balance of the glass was finer than 28 mesh. The reground inorganic material was again screened with a 28 mesh screen and the material which passed through combined with the material which originally passed by the 28 mesh screen.

The portion having a particle size exceeding 28 mesh was combined with metals exceeding 3 mesh. The resultant coarse mixture was found to be 90% metallic.

The inorganic fraction which was finer than 28 mesh was deslimed and classified to remove materials finer than 150 mesh and the −28 to +150 mesh matter conditioned in a conventional froth flotation operation using as the flotation reagent a secondary amine which was the reaction product of tall oil and diethylene triamine. The amount employed was equivalent to 0.5 lbs. per ton of particulate inorganic matter. Included with the amine was kerosene in an amount equivalent to 1 lb. per ton of crushed inorganic matter and pine oil as a frother. The pH of the system was essentially neutral.

After treatment in a conventional manner for 20 seconds the glass floated off. The glass fraction was then recycled after removing the inorganic tailing to form a cleaner fraction by repeating the flotation operation. The purity of the glass was further improved by magnetic separation of contained ferromagnetic materials and was directly suitable for use in forming glass objects and vessels.

EXAMPLE 2

A dry inorganic fraction obtained in the processing of municipal wastes and containing glass fragments was comminuted in a rod mill for 45 minutes. Over 99% of the glass and most of the brittle material in the ground product passed through an 8 mesh screen, which retained about 75% of the metals in the original inorganic fraction. The metallic content of the fraction which exceeded 8 mesh was about 85% metals, and the balance stones plus some plastic, wood, and minor glass fragments.

The balance of the inorganic fraction was screened at 32 mesh (Tyler) and a portion coarser than 32 mesh was reground to pass 32 mesh. The inorganic fraction which was finer than 32 mesh was classified and deslimed to remove the material finer than about 200 mesh, and the 32 to 200 mesh material conditioned with Armeen C( SM ), a primary cocoamine manufactured by Armour Industrial Chemicals Company in an amount equivalent to about 0.3 lb./ton of solids. The pH of the system was essentially neutral. After conditioning, the glass and amine together in a 25% solids slurry was floated off in a conventional manner for 5 minutes. The floated glass was recleaned in another flotation step with no additional reagents being added. After drying, ferromagnetic impurities were removed with an induced roll magnetic separator. In this example of the glass originally present in the dry inorganic fraction processed, 81% appeared within the grouping between 32 and 200 mesh. The flotation separation operation recovered 95% of the glass within this grouping which represented an overall recovery of 77% of the glass in the dry inorganic fraction obtained in the processing of municipal waste.

EXAMPLE 3

An air classifier underflow from the processing of municipal trash was screened to obtain a glass-rich −4 to +10 mesh fraction. This was ground in a rod mill and rescreened to give a −42 to +200 mesh material consisting of glass, bones, metals, bricks and other metals. After desliming the material, a portion was subjected to flotation using a primary amine containing octylamine in an amount equivalent to 0.9 lbs. per ton of the dry ground feed material. Approximately 35% of the contained glass was obtained in a clean float product.

EXAMPLE 4

Another portion of the dried deslimed material obtained in Example 3 was conditioned in a flotation cell with a mixture of equal quantities of kerosene, and docosaneamine. The reagent mixture was used in an amount equivalent to 1 lb. per ton of dry ground material. In the flotation operation about 90% of the dry glass was recovered in the float fraction and was of reasonable purity.

EXAMPLE 5

Another portion of the dry deslimed material prepared in Example 3 was conditioned with a tertiary amine derived from the reaction of tall oil and N,N dimethyl aminopropylamine in an amount equivalent to 0.57 lb. per ton of dry deslimed material and 1 lb. of kerosene per ton of dry deslimed material. Approximately 50% of the glass contained in the feed was recovered as a very clean glass product.

EXAMPLE 6

500 Parts by weight of an undeslimed minus 20 mesh inorganic fraction recovered from municipal solid waste and containing glass was subjected to flotation in a Wemco flotation cell operated at 1000 RPM with 1.5 lb./ton of tallowamine acetate. Flotation of glass readily occurred, but with a consdierable portion of other inorganics. Reagent requirement was about 3 times that normally required to achieve an effective float of glass from particles in the size range between 20 and 325 mesh.

EXAMPLE 7

An inorganic mass recovered from solid waste processing containing about 80 percent by weight glass and of a particle size less than 0.25 inch was subjected to flotation using an equivalent of 2 lb./ton of tallowamine acetate in a Wemco cell operated at 1000 rpm. The feed was partially deslimed to remove some fines. Screening of the float concentrate and tailing established that some of the 10 to 8 mesh glass was recovered. The detailed results are shown in Table I.

Table I

| | |
|---|---|
| Feed (−0.25 in.), parts by weight | 541 |
| Float concentrate, parts by weight | 338.6 |
| Tailing, parts by weight | 203.3 |

| Mesh Size | % Glass in Feed | % Glass in Float | % Glass Floated |
|---|---|---|---|
| +8 | 3.4 | 0 | 0 |
| −8, +10 | 4.6 | 1.2 | 16.0 |
| −10, +12 | 2.8 | 2.0 | 42.7 |
| −12, +16 | 11.9 | 13.3 | 70.0 |
| −16, +20 | 7.3 | 10.7 | 91.0 |
| −20 | 46. | 73.0 | 99.0 |

EXAMPLE 8

To establish the ability to float glass from quartz, a mixture containing 50 grams of quartz sand of a particle size between 60 and 100 mesh and 50 grams of green glass of a particle size between 100 and 200 mesh was prepared. The mixture was subject to flotation at ambient temperature in a 1 liter Wemco cell. The amine flotation reagent was a tallow diamine diacetate known as DUOMAC T manufactured and sold by Armour and Company. The amount added was 4 mg. Water pH was between 7 and 8. The approximate slurry density was 10% and the flotation was carried out until the froth was barren. Forty four grams of a green glass float was obtained. Purity was 97.5%, and recovery 85%. 54.4 grams of tails were recovered containing 85 to 90% of the quartz sand. Mechanical losses were 1.6 grams. Analysis of both the fractions was carried out by screening at 100 mesh.

Our work has established that amines where all hydrocarbon groups contain less than 5 carbon atoms such as tripropyl amine, tributylamine and tripentyl amines to be functional. Amines such as diheptyl amine may be rendered functional in the presence of an extender such as diesel oil and the like. Amines which contain more than 22 carbon atoms in a hydrocarbon group may be used provided they are or can be rendered water soluble. In the use of quaternary ammonium salts, the use of quaternary ammonium salts which are wetting agents, such as the ammonium chlorides of a polyoxyamine, are to be avoided.

There is pending a continuation application based on subject matter disclosed in the instant specification and containing claims of scope different than the claims of this patent.

What is claimed is:

1. A process for separating glass from a particulate mixture of inorganic materials which comprises subjecting a particulate mixture of inorganic materials including particles of a size up to about 28 mesh and containing, as a portion thereof, a quantity of particulate glass particles comprising glasses having the composition of from about 70 to about 73 percent by weight $SiO_2$, from about 11 to about 18 percent by weight $Na_2O$, from about 7 to about 17 percent by weight CaO, the balance being essentially other metal oxides to froth flotation with a beneficiating amount of at least one functional amine glass collector reagent, said amine containing from about 8 to about 22 carbon atoms in at least one hydrocarbon group attached to a nitrogen atom to form a float fraction comprising predominantly particulate glass and an inorganic tailing substantially free of particulate glass, at least a portion of said particulate mixture of inorganic materials, exclusive of the particulate glass particles, being nonresponsive to the beneficiating action of said amine collector reagent to cause the particulate glass particles to concentrate in the float fraction.

2. A process as claimed in claim 1 in which a substantial portion of the particulate mass of inorganic materials has a particle size between about 150 and about 32 mesh.

3. A process as claimed in claim 1 in which the amine collector reagent is present in an amount equivalent to about 0.15 to about 2 lbs. per ton of said particulate mixture of inorganic materials.

4. A process as claimed in claim 1 in which the amine collector reagent is selected from the group consisting of cocoamine, the reaction product of tall oil and diethylene triamine, octylamine, decosaneamine, the reaction product of tall oil and N,N dimethyl aminopropylamine, and tallowamine.

5. A process as claimed in claim 4 in which the amine collector reagent is present in an amount equivalent to about 0.15 to about 2 lbs. per ton of said particulate mixture of inorganic materials.

6. A process as claimed in claim 1 in which there is present an extender for the amine collector reagent.

7. A process as claimed in claim 6 in which the extender is present in an amount up to an equivalent of about 3 lbs. per ton of said particulate inorganic materials.

8. A process as claimed in claim 1 in which a frothing agent is present.

9. A process as claimed in claim 8 in which the frothing agent is present in an amount up to about 0.5 lb. per ton of said particulate inorganic materials.

10. A process as claimed in claim 1 in which the amine collector reagent is selected from the group consisting of primary amines and secondary amines.

11. A process for separating glass from a particulate mixture of substantially inorganic materials which comprises subjecting a particulate mixture of inorganic materials having a particle size between about 200 mesh and about 28 mesh and containing, as a portion thereof, a quantity of particulate glass particles comprising glasses having the composition of from about 70 to about 73 percent by weight $SiO_2$, from about 11 to about 18 percent by weight $Na_2O$, from about 7 to about 17 percent by weight CaO, the balance being essentially other metal oxides to froth flotation with a beneficiating amount of at least one functional amine glass collector reagent, said amine containing from about 8 to about 22 carbon atoms in at least one hydrocarbon group attached to the nitrogen atom to form a float fraction comprising predominantly particulate glass and an inorganic tailing substantially free of particulate glass, at least a portion of said particulate mixture of inorganic materials, exclusive of the particulate glass particles, being nonresponsive to the beneficiating action of said amine collector reagent to cause the particulate glass particles to concentrate in the float fraction.

12. A process as claimed in claim 11 in which the amine collector reagent is present in an amount equivalent to about 0.15 to about 2 lbs. per ton of said particulate mixture of inorganic materials.

13. A process as claimed in claim 11 in which the amine collector reagent is selected from the group consisting of cocoamine, the reaction product of tall oil and diethylene triamine, octylamine, decosaneamine, the reaction product of tall oil and N,N dimethyl aminopropylamine, and tallowamine.

14. A process as claimed in claim 13 in which the amine collector reagent is present in an amount equivalent to about 0.15 to about 2 lbs. per ton of said particulate mixture of inorganic materials.

15. A process as claimed in claim 11 in which there is present an extender for the amine collector reagent.

16. A process as claimed in claim 15 in which the extender is present in an amount up to an equivalent of about 3 lbs. per ton of said particulate inorganic materials.

17. A process as claimed in claim 11 in which a frothing agent is present.

18. A process as claimed in claim 17 in which the frothing agent is present in an amount up to about 0.5 lb. per ton of said particulate inorganic materials.

19. A process as claimed in claim 18 in which a frothing agent is present.

20. A process as claimed in claim 19 in which the frothing agent is present in an amount up to about 0.5 lb. per ton of said particulate mass of inorganic tailing.

21. A process as claimed in claim 11 in which the amine collector reagent is selected from the group consisting of primary amines and secondary amines.

22. In a process for the treatment of solid wastes for recovery of values contained therein which includes classifying the solid waste into an organic fraction, a metals fraction and an inorganic tailing including glasses having the composition of from about 70 to about 73 percent by weight $SiO_2$, from about 11 to about 18 percent by weight $Na_2O$ and from about 7 to about 17 percent by weight CaO, the balance being essentially other metal oxides, said inorganic tailing being substantially free of organics and metals, the improvement which comprises:

a. forming from the inorganic tailing a particulate inorganic mass including said glasses and having a particle size up to about 28 mesh;

b. subjecting the particulate inorganic mass to froth flotation in the presence of a beneficiating amount of at least one functional amine glass collector reagent, a said amine collector reagent containing from about 8 to about 22 carbon atoms in at least one hydrocarbon group attached to a nitrogen atom to form a float fraction predominantly comprising said particulate glasses and an inorganic residue substantially free of said glasses.

23. A process as claimed in claim 22 in which the amine collector reagent is present in an amount equivalent to about 0.15 to about 2 lbs. per ton of said particulate mixture of inorganic materials.

24. A process as claimed in claim 22 in which the amine collector reagent is selected from the group consisting of cocoamine, the reaction product of tall oil and diethylene triamine, octylamine, decosaneamine, the reaction product of tall oil and N,N dimethyl aminopropylamine, and tallowamine.

25. A process as claimed in claim 24 in which the amine collector reagent is present in an amount equivalent to about 0.15 to about 2 lbs. per ton of said particulate mixture of inorganic materials.

26. A process as claimed in claim 22 in which there is present an extender for the amine collector reagent.

27. A process as claimed in claim 26 in which the extender is present in an amount up to an equivalent of about 3 lbs. per ton of said particulate inorganic materials.

28. A process as claimed in claim 22 in which a frothing agent is present.

29. A process as claimed in claim 28 in which the frothing agent is present in an amount up to about 0.5 lb. per ton of said particulate inorganic materials.

30. A process as claimed in claim 22 in which the amine collector reagent is selected from the group consisting of primary amines and secondary amines.

31. In a process for the treatment of solid wastes for recovery of values contained therein which includes classifying the solid waste into an organic fraction, a metals fraction and an inorganic tailing including glasses having the composition of from about 70 to about 73 percent by weight $SiO_2$, from about 11 to about 18 percent by weight $Na_2O$ and from about 7 to about 17 percent by weight CaO, the balance being essentially other metal oxides, said inorganic tailing being substantially free of organics and metals, the improvement which comprises:

a. forming from the inorganic tailing a particulate inorganic mass including said glasses having a particle size between about 200 and about 28 mesh;

b. subjecting the particulate inorganic mass to froth flotation in the presence of a beneficiating amount of at least one functional amine glass collector reagent, a said amine containing from about 8 to about 22 carbon atoms in at least one hydrocarbon group attached to a nitrogen atom to form a float fraction predominantly comprising said particulate glasses and an inorganic residue substantially free of said glasses.

32. A process as claimed in claim 31 in which the amine collector reagent is selected from the group consisting eof primary amines and secondary amines.

33. A process as claimed in claim 31 in which the amine collector reagent is present in an amount equivalent to about 0.15 to about 2 lbs. per ton of said particulate mass of inorganic tailing.

34. A process as claimed in claim 32 in which the amine collector reagent is present in an amount equivalent to about 0.15 to about 2 lbs. per ton of said particulate mass of inorganic tailing.

35. A process as claimed in claim 31 in which the amine collector reagent is selected from the group consisting of cocoamine, the reaction product of tall oil and diethylene triamine, octylamine, decosaneamine, the reaction product of tall oil and N,N dimethyl aminopropylamine, and tallowamine.

36. A process as claimed in claim 35 in which the amine collector reagent is present in an amount equivalent to about 0.15 to about 2 lbs. per ton of said particulate mass of inorganic tailing.

37. A process as claimed in claim 31 in which there is present an extender for the amine collector reagent.

38. A process as claimed in claim 37 in which the extender is present in an amount up to an equivalent of about 3 lbs. per ton of said particulate mass of inorganic tailing.

39. A process for separating glass from a mixture of inorganic materials containing as a part thereof particulate glass having a particle size less than a preselected mesh size which comprises:

a. separating materials having a particle size greater than the preselected mesh size from the materials having a particle size less than the preselected mesh size;

b. further comminuting the materials having a particle size less than the preselected mesh size to a size containing particulate glass having particle size less than about 28 mesh;

c. classifying the mixture of inorganic materials having a particle size less than about 28 mesh to remove particles having a size less than about 200 mesh;

d. separating the particulate glass fraction from the mixture of inorganic materials having a particle size between about 200 and about 28 mesh by froth flotation to form a float containing predominantly glass, said glass including glasses having the composition of from about 70 to about 73 percent by weight $SiO_2$, from about 11 to about 18 percent by weight $Na_2O$ and from about 7 to about 17 percent by weight CaO, the balance being essentially other metal oxides using a beneficiating amount of at least one amine glass collector reagent, said amine collector reagent containing from about 8 to about 22 carbon atoms in at least one hydrocarbon group attached to a nitrogen atom, at least a portion of said particulate mixture of inorganic materials, exclusive of the particulate glass particles, being non-responsive to the beneficiating action of said amine collector reagent to cause the particulate glass particles to concentrate in the float fraction.

40. A process as claimed in claim 39 in which there is present an extender for the amine collector reagent.

41. A process as claimed in claim 40 in which the extender is present in an amount up to an equivalent of about 3 lbs. per ton of said particulate inorganic materials.

42. A process as claimed in claim 39 in which a frothing agent is present.

43. A process as claimed in claim 42 in which the frothing agent is present in an amount up to about 0.5 lb. per ton of said particulate inorganic materials.

44. A process as claimed in claim 39 in which the preselected mesh size is 3 mesh.

45. A process as claimed in claim 39 in which the amine collector reagent is selected from the group consisting of primary amines and secondary amines.

46. A process as claimed in claim 39 in which the amine collector reagent is present in an amount equivalent to about 0.15 to about 2 lbs. per ton of said particulate mixture of inorganic materials.

47. A process as claimed in claim 39 in which the amine collector reagent is selected from the group consisting of cocoamine, the reaction product of tall oil and diethylene triamine, octylamine, decosaneamine, the reaction product of tall oil and N,N dimethyl aminopropylamine, and tallowamine.

48. A process as claimed in claim 47 in which the amine collector reagent is present in an amount equivalent to about 0.15 to about 2 lbs. per ton of said particulate mixture of inorganic materials.

* * * * *